US005639294A

United States Patent [19]

Ranstad

[11] Patent Number: 5,639,294

[45] Date of Patent: Jun. 17, 1997

[54] METHOD FOR CONTROLLING THE POWER SUPPLY TO AN ELECTROSTATIC PRECIPITATOR

[75] Inventor: Per Ranstad, Växjö , Sweden

[73] Assignee: ABB Flakt AB, Stockholm, Sweden

[21] Appl. No.: 495,546

[22] PCT Filed: Jan. 27, 1994

[86] PCT No.: PCT/SE94/00057

§ 371 Date: Sep. 19, 1995

§ 102(e) Date: Sep. 19, 1995

[87] PCT Pub. No.: WO94/16820

PCT Pub. Date: Aug. 4, 1994

[30] Foreign Application Priority Data

Jan. 29, 1993 [SE] Sweden ..... 9300306

[51] Int. Cl.[6] ..... B03C 3/68

[52] U.S. Cl. ..... 95/6; 95/7; 95/81; 96/21; 96/82; 323/903

[58] Field of Search ..... 95/6, 7, 80, 81; 96/20–24, 80, 82; 323/903

[56] References Cited

U.S. PATENT DOCUMENTS

| | | | |
|---|---|---|---|
| 4,326,860 | 4/1982 | Laugesen | 96/20 |
| 4,354,152 | 10/1982 | Herklotz et al. | 96/20 X |
| 4,522,635 | 6/1985 | Matts | 95/81 X |
| 4,605,424 | 8/1986 | Johnston | 95/5 |
| 4,659,342 | 4/1987 | Lind | 323/903 X |
| 4,808,200 | 2/1989 | Dallhammer et al. | 95/6 |
| 4,936,876 | 6/1990 | Reyes | 95/7 X |
| 5,255,178 | 10/1993 | Liberati | 96/80 |
| 5,311,420 | 5/1994 | Zarfoss et al. | 95/6 X |

FOREIGN PATENT DOCUMENTS

| | | | |
|---|---|---|---|
| 0 508 961 | 10/1992 | European Pat. Off. . | |
| 549007 | 6/1993 | European Pat. Off. | 95/7 |
| 3522568 | 1/1987 | Germany . | |
| 1 402 149 | 8/1975 | United Kingdom . | |
| WO 87/01306 | 3/1987 | WIPO . | |
| WO 88/7413 | 10/1988 | WIPO . | |

*Primary Examiner*—Richard L. Chiesa
*Attorney, Agent, or Firm*—Burns, Doane, Swecker & Mathis, L.L.P.

[57] ABSTRACT

Method for controlling, in case of flashover between electrodes in an electrostatic precipitator, the current supply to the electrodes from a controllable high-voltage direct-current source. The current supplied to the precipitator and the voltage between the electrodes of the precipitator are measured substantially continuously or at close intervals. After the flashover, the current supply to the electrodes of the precipitator is completely interrupted during a first time interval. During a second time interval directly following the first time interval, a current which is greater that the one supplied immediately before the flashover is supplied to the precipitator. Subsequently, the current is reduced to a value below the one prevailing immediately before the flashover.

23 Claims, 2 Drawing Sheets

METHOD FOR CONTROLLING THE POWER SUPPLY TO AN ELECTROSTATIC PRECIPITATOR

FIELD OF THE INVENTION

The present invention relates to a method for controlling the power supply in case of flashover between the electrodes of an electric precipitator. Power is supplied by a controllable high-voltage direct-current source.

The case in which the advantages of the method are particularly great, is the one in which the electrostatic precipitator operates with an exceedingly high flashover frequency. At the present level of technology, e.g. modulated high-frequency high-voltage rectifiers are suitable means for carrying out the method.

The invention is applied when the dust to be separated does not have such high resistivity that there is a risk of breakdown in the dust layer formed on the collecting electrodes. The invention is of no particular use when separating dust of such high resistivity that the voltage or current must be restricted owing to back-corona.

BACKGROUND OF THE INVENTION

In many contexts, especially in flue gas cleaning, electrostatic precipitators are the most suitable dust collectors. Their design is robust and they are highly reliable. Moreover, they are most efficient. Degrees of separation above 99.9% are not unusual. Since, when compared with fabric filters, their operating costs are low and the risk of damage and stoppage owing to functional disorders is considerably smaller, they are a natural choice in many cases. In an electrostatic precipitator, the polluted gas is conducted between electrodes connected to a high-voltage rectifier. Usually, this is a high-voltage transformer with thyristor control on the primary side and a rectifier bridge on the secondary side. This arrangement is connected to the ordinary AC mains and thus is supplied at a frequency which is 50 or 60 Hz.

The power control is effected by varying the firing angles of the thyristors. The smaller the firing angle, i.e. the longer conducting period, the more current supplied to the precipitator and the higher the voltage between the electrodes of the precipitator.

When separating dust of low or moderate resistivity, the degree of separation increases as the voltage between the electrode increases. The separation will thus be more effective at high voltage. The possible voltage is, however, not restricted by the construction of the high-voltage rectifier only, but also by the fact that at sufficiently high voltage, there will be flashover between the electrodes in the precipitator.

The optimal separation is therefore obtained when the voltage applied is just below the one causing flashover. Since the flashover limit may vary strongly according to varying operating conditions, a constant voltage is, unfortunately, not possible if one tries to obtain optimal separation, but instead one must frequently test the flashover limit by permitting flashover between the electrodes.

This is effected by slowly increasing the current until flashover occurs. Subsequently, the current is reduced in a predetermined manner and then again slowly increased until the next flashover. The procedure is repeated periodically. If the circumstances result in a highly varying flashover limit, more than 100 flashovers a minute may be acceptable. In more stable processes, 10 flashovers a minute may be involved. In certain processes, the best separation is however obtained at very high flashover frequencies although the operation is very stable. Up to now, this has not been explained in a satisfactory manner, but is verified by experience.

Examples of the technique of controlling are to be found in, inter alia, GB 1,402,149, FIG. 8 showing the fundamental reasoning. In case of flashover, the current is interrupted during a first time interval, and then the current is rapidly increased from zero, during a second time interval after which it is increased slowly when a given value, depending on the value before the flashover, has been achieved.

To ensure that the flashover does not lead to a permanent arc and, thus, sets the precipitator out of operation for a long time, the first time interval, during which the current is interrupted, must be at least a half-circle of the mains voltage. The current is usually interrupted during an entire cycle of the mains voltage, partly because otherwise the excitation of the transformer, when reconnected, yields a very high overload on the mains and increases the losses in the transformer windings.

This technique therefore implies that the precipitator is dead for 20 milliseconds up to 100 times a minute or even more frequently. Moreover, it will be appreciated that the separation is not fully effective also during the second time interval, when the precipitator is being recharged and the voltage between the electrodes is essentially below the value at which the flashover occurred. If the second time interval is estimated at about 100 milliseconds like in FIG. 8 of GB 1,402,149, the precipitator may, in extreme cases, be out of operation during almost as much as 10% of the total time. This is a strongly restricting factor at a high flashover frequency.

In conventional thyristor-controlled rectifiers, the current cannot be interrupted until the next zero point of the mains voltage. This means that the precipitator can function as a short-circuit load for a considerable time, between the flashover and the next zero point of the mains voltage. If the flashover occurs early during the half-circle, this state can prevail for almost 10 milliseconds.

To reduce the negative consequences of the wish of having a high flashover frequency, it is possible to operate with a higher frequency of the voltage, and, thus, via a converter avoid the dependence on the mains voltage. This has been suggested in e.g. DE 3,522,568, in which a voltage having a frequency of 2 kHz or more is generated in a converter, and in WO 88/00159 in which an embodiment states 50 kHz, but frequencies up to 200 kHz are mentioned.

By these methods, the time during which the current must be interrupted is reduced. It has proved sufficient to have an interruption of the current supply corresponding to the length of period also for these high frequencies. Instead of an interruption of 20 milliseconds, an interruption which is essentially shorter than 1 millisecond may thus be sufficient.

By these methods, also the loss of energy in the actual flashover is reduced. When the frequency is increased to e.g. 2 kHz, the current can be effectively interrupted as soon as after 0.5 millisecond or even earlier, at 50 kHz as soon as after 0.02 millisecond. This may not have any decisive influence on the total losses of energy, but the stress to which electric components and some mechanical components are subjected will be reduced.

OBJECT OF THE INVENTION

The prior art, since long established rectifier technique for electrostatic precipitators has, in case of flashover, three important drawbacks. One depends on the time it takes before the current can be interrupted, and the other two are associated with the time it takes before full operating voltage has again been achieved between the electrodes of the precipitator after the point of time of interrupting the current supply.

The recently presented methods which have been discussed above and which use modulated high-frequency converters have essentially reduced two of the problems by shortening the time between a flashover and the provision of current interruption, and by reducing the first time interval during which no current is supplied to the precipitator. The third problem which concerns the second time interval during which current is supplied to the electrodes of the precipitator, but full operating voltage has not been achieved, has, however, not been solved in a satisfactory manner.

The main object of the present invention is to provide a method of reducing, by simple means, the time during which the precipitator does not operate effectively because, during a second interval, the voltage between the electrodes after a flashover is lower than the desired one. A further object of the invention is to provide a method of optimising the fundamental method selected.

SUMMARY OF THE INVENTION

The present invention relates to a method for controlling, in case of flashover between the electrodes of an electrostatic precipitator, the power supply to the electrodes from a controllable high-voltage direct-current source. According to the inventive method, the current supplied to the precipitator and the voltage between the electrodes of the precipitator are measured in an essentially continuous manner, or at close intervals. After the flashover, the power supply to the electrodes of the precipitator is fully interrupted during a first time interval. During a second time interval directly following the first one, a current is supplied to the precipitator, which is greater than the one supplied immediately before the flashover. Subsequently, the current is reduced to a value below the one prevailing immediately before the flashover.

GENERAL DESCRIPTION OF THE INVENTION

An electrostratic precipitator can, in operation, be conceived as a great condenser in the first place, its geometrical dimensions are great and may be in the order of more than 10 m. Its electric capacitance is fairly restricted, frequently in the order of 100 nF. At the existing high voltages, this means, however, that the charge in the filter is considerable and the amount of stored energy even fairly great, up to some hundred joules.

In case of a discharge owing to a flashover, this energy and the charge associated therewith are lost. One of the purposes of the high-voltage rectifier after a flashover is to reset the lost charge. Only after that, the normal operating conditions arise. When this recharge occurs, the exact amount of charge that need be reset is usually not known, nor the exact voltage which is to be achieved. For this reason and, possibly, owing to restrictions of the equipment, the conduction angle of the thyristors is, in conventional systems, successively increased from zero up to operating conditions. Similarly, a successive charge resetting is made in the new systems with modulated high-frequency converters.

According to the present invention, it is suggested that recharge is effected by means of the maximum current of the rectifier or at least by means of a current which essentially exceeds the previous operating current so as to reset more quickly the charge of the precipitator and, consequently, reduce the time during which the precipitator operates less effectively. This can be effected according to the proposed method since first the charge which has been lost in the flashover and need be reset to the precipitator is measured or calculated, and subsequently a time interval is determined, which is required for recharging the precipitator by means of the selected supply current, the voltage between the electrodes thus achieving a value at which the corona current goes below, in a predetermined manner, the value at which the last flashover occurred.

Deviations from ideality exist owing to the voltage between the electrodes not quite falling to zero at the flashover, and owing to a certain amount of current flowing between the electrodes during the latter part of this recharge. Since these effects counteract each other, it is, however, possible to estimate with sufficient accuracy the time during which the precipitator need be charged by means of the maximum current or the selected charge current so as to achieve the desired level of voltage.

The time required for recharge depends, for self-evident reasons, on the capacity in voltage supply, converters, e.g. a modulated high-frequency generator, and high-voltage rectifiers. These should be dimensioned such that the recharge takes less than 20 milliseconds, preferably less than 10 milliseconds.

According to the proposed method, the frequency at which a modulated high-frequency high-voltage rectifier operates, should be selected such that the interruption in the current supply, i.e. the first time interval, is less than 5 milliseconds, preferably less than 1 millisecond.

BRIEF DESCRIPTION OF THE DRAWINGS

The invention will now be described in more detail with reference to the accompanying drawings in which.

DESCRIPTION OF A PREFERRED EMBODIMENT

Figure 1:
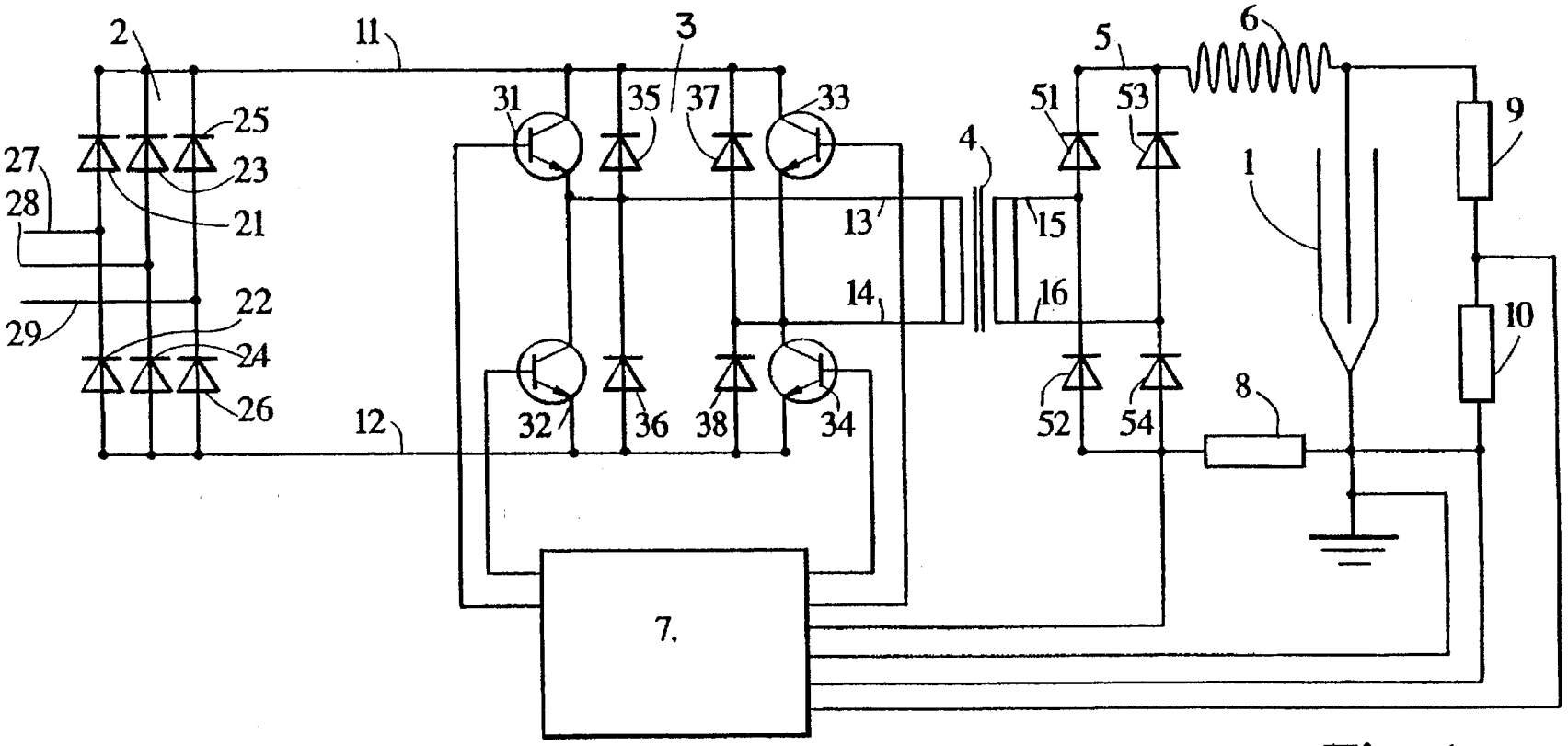
FIG. 1 is a simplified wiring diagram for a device which is suitable for carrying out the proposed method.

FIG. 1 is a fundamental wiring diagram of a voltage-converting device which supplies high-voltage direct current to a precipitator 1. The device comprises a three-phase rectifier bridge 2, a pulse generator 3, a transformer 4, a one-phase full-wave rectifier bridge 5, a choke 6, and control equipment 7 with precision resistors 8, 9 and 10.

The three-phase rectifier bridge 2 comprises six diodes 21–26 and is, via three conductors 27, 28, 29, connected to ordinary three-phase AC mains.

The pulse generator 3 comprises four transistors 31–34 and four diodes 35–38. The transistors are controlled by their bases being connected to the control equipment 7.

The full-wave rectifier bridge 5 consists of four diodes 51–54.

The control equipment 7 is connected not only to the transistors 31–34, but also to a precision resistor in series with the precipitator 1, for measuring the current to the electrodes of the precipitator, and to a voltage divider comprising two resistors 9 and 10 connected between the electrodes of the precipitator for measuring the voltage between them.

The device functions as follows. Via the conductors 27–29, the rectifier bridge 2 is supplied with three-phase alternating current. This is rectified and is transferred, via conductors 11 and 12, as a direct current to the pulse generator 3. The control equipment 7 controls the conducting periods of the transistors 31–34 such that a pulse-width-modulated voltage, essentially formed as a square wave, is supplied, via conductors 13 and 14, to the primary side of the transformer 4.

The voltage induced in the secondary winding of the transformer 4 is rectified by the rectifier bridge 5 and, via the smoothing choke 6, the obtained direct current is supplied to the electrodes of the precipitator 1.

As mentioned above, the control equipment 7 controls the transistors 31–34 and moreover monitors the current and voltage of the precipitator via the resistors 8 and 10. Since the conducting periods of the transistors are controlled, the pulse width of the generated, essentially square-wave-formed current can be varied and, consequently, both current and voltage in the precipitator are controlled.

The control principles may be varied in many ways according to the conditions prevailing in the precipitator and, thus, be adjusted to achieve a minimum of environmental hazards or to satisfy the requirements of the authorities.

When carrying out the proposed method, the prevailing capacitance value of the precipitator should be stored in the control equipment. The control equipment can possibly measure this value by itself. If necessary, the control equipment should, by means of comparisons with the actual result, also correct the previously stored capacitance value. In case of flashover, the control equipment 7 should also calculate the charge which is present in the precipitator. Moreover, the control equipment should, during the second time interval, integrate the measured value of the current and, when this integrated measured value bears a predetermined relation to the calculated value of the charge in the precipitator immediately before the flashover, change the control parameters of the transistors 31–34, thereby reducing the current.

Figure 2A:
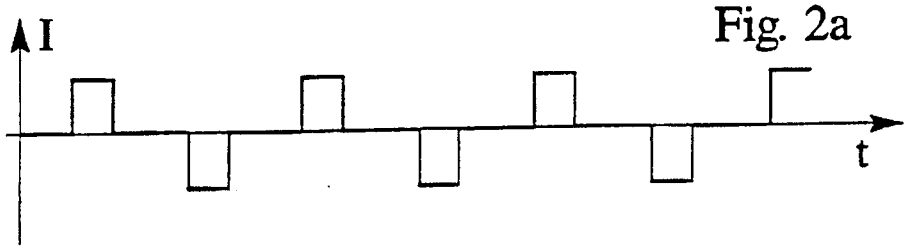
FIGS. 2A and 2B illustrates the time dependence of the current from the pulse generator to the transformer in the diagram according to FIG. 1 for two different load cases.
Figure 2B:
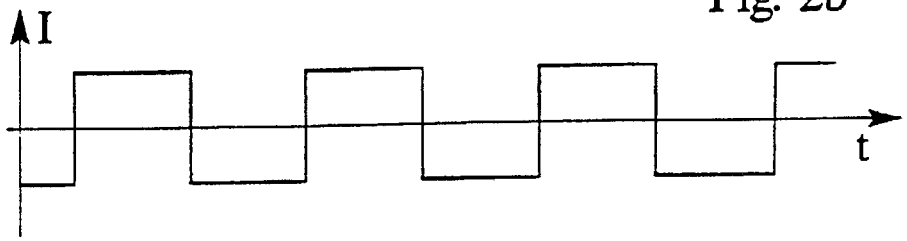

FIG. 2 illustrates how the current from the pulse generator 3 to the transformer 4 may be imagined to be dependent on the time of two different load cases. One load case corresponds to about 40% of the maximum load, and the other corresponds to the maximum load. The pulse frequency is 50 kHz, and the length of the pulses in the example illustrated in FIG. 2*a* is about 4 microseconds. The period is 20 microseconds. In case of full load as illustrated in FIG. 2*b*, the pulse length is 10 microseconds. The period is the same as in FIG. 2*a*, 20 microseconds.

FIGS. 3 and 4 having a completely different time scale from FIG. 2 illustrate how current and voltage are dependent on the time immediately after a flashover. FIG. 3 illustrates the previously used control principle, and FIG. 4 illustrates the control principles while applying the inventive method.

Figure 3A:
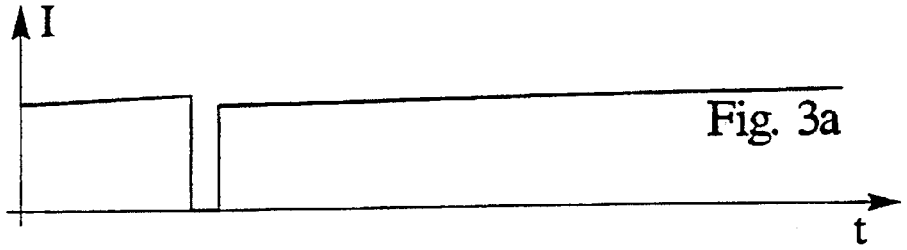
FIGS. 3A and 3B illustrates current and voltage respectively, in the electrostatic static precipitator as a function of the time according to the previously used method.

FIG. 3*a* shows, in a slightly simplified manner, how the current is controlled according to the previously used control principle. In case of flashover, the current is completely interrupted for one millisecond and is then increased jumpwise to 75% of the current which, immediately before the flashover, was registered by means of the resistor 8. The value 75% is selected for illustration purposes. The amount should normally be higher.

In this embodiment, the current is assumed to be about 40% of the maximum current from the pulse generator and, thus, correspond to the load case in FIG. 2. From this value, the current is slowly increased until the next flashover occurs, and the procedure is repeated. The jumpwise increase and the following slow increase of the current are dependent on the desired flashover frequency and are adapted such that the flashover frequency is kept almost constant.

Figure 3B:
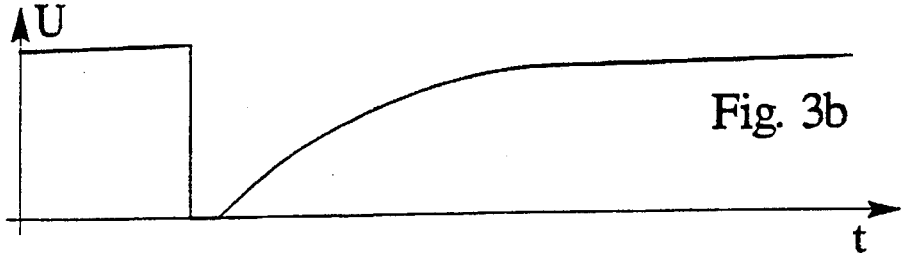

FIG. 3*b* illustrates how the voltage between the electrodes of the electrostatic precipitator will vary in time when current is supplied according to the control principle shown in FIG. 3*a*. If the pulse generator can maximally generate 1 A as supply current to the precipitator 1 and this is assumed to have the capacitance 80 nF, it will in this manner, thus with the current 0.4 A, i.e. 40% of the maximum current, theoretically take 10 milliseconds to charge it to 50 kV.

Figure 4A:
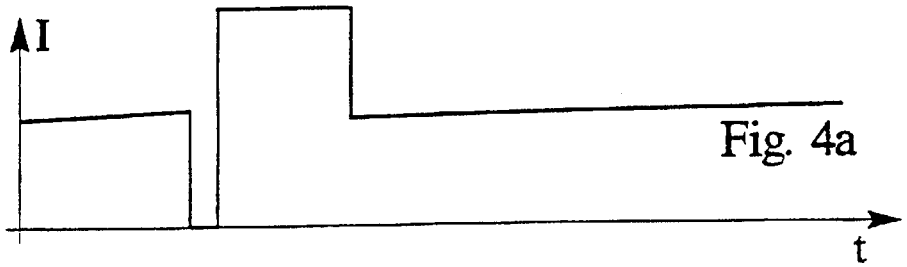
FIGS. 4A and 4B shows the current and voltage, respectively, in the electrostatic precipitator as a function of the time according to the proposed method.

FIG. 4*a* illustrates, in a slightly simplified manner, how the current is controlled according to the inventive method. In case of flashover, the current is fully interrupted for 1 millisecond and is then jumpwise increased to the maximum current of the pulse generator. After a charge corresponding the one lost in the flashover in the precipitator 1 has been recharged to the precipitator, the current is then reduced jumpwise to about 75% of the current which immediately before the flashover was registered by means of the resistor 8. From this value, the current is slowly increased until the next flashover occurs, and the procedure is repeated. The slow increase of the current depends on the desired flashover frequency and is adapted such that the flashover frequency is kept almost constant. The relation between the estimated lost charge and the charge supplied during the second time interval can, for the same reasons, be varied such that a slightly smaller charge than the theoretically calculated one is supplied during this time interval.

Figure 4B:
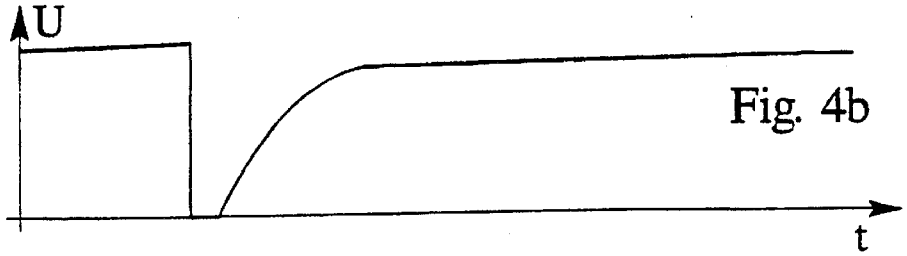

FIG. 4*b* illustrates how the voltage between the electrodes of the electrostatic precipitator will vary in time when current is supplied according to the now proposed method shown in FIG. 4*a*. If the pulse generator can maximally generate 1 A as supply current to the precipitator 1 and this is assumed to have the capacitance 80 nF, it will in this manner, i.e. the current being 1.0 A, which is the maximum current, theoretically take 4 milliseconds to charge the precipitator to 50 kV.

In this embodiment, it is assumed that the capacitance of the precipitator is measured in advance, and that the value is stored in the control equipment 7. The control equipment calculates the second time interval during which the pulse generator should generate the maximum current by integrating, during this second time interval, the measured value of the current and interrupting the charge when the integral corresponds to the charge calculated from the previous voltage, or by dividing the calculated charge by the supplied constant current and directly determining the length of the interval.

ALTERNATIVE EMBODIMENTS

The inventive method is, of course, not restricted to the embodiment described above, but may be varied in many ways within the scope of the appended claims.

The method can be applied to a plurality of other techniques of supplying current, in the form of pulses or high-frequency alternating current. Examples of such techniques are phase angle modulation, frequency modulation and series resonant or parallel resonant converters.

The proposed method also makes it possible to change the dimensions of the high-voltage direct-current source. Since the advantage resides in a changed control technique during the short second time interval, the equipment may possibly be designed to briefly supply an essentially greater current than the continuous maximum load. Comparisons may be made with e.g. audioamplifiers which may give very great additional transient effects. Since the advantages of the method depend on the relation between the maximum current and the continuous operating current, this modification makes it possible to increase the efficiency gain.

Examples of variants of the method are other techniques of measuring the capacitance in the precipitator, other techniques of determining the charge in the precipitator and other techniques of measuring the charge supplied during the recharge.

The possibility of letting the length of the second time interval be determined by detection of the voltage actually occurring in the precipitator should not be excluded, but it is connected with considerable practical problems, among other things because it is most difficult to find, in such very quick processes, measured values which are reasonably reliable.

I claim:

1. Method for controlling, in case of flashover between electrodes in an electrostatic precipitator, the current supply to the electrodes from a controllable high-voltage direct-current source, wherein the current supplied to the precipitator is measured substantially continuously, or at close intervals;

the method comprising the steps of:

measuring the voltage between the electrodes of said precipitator substantially continuously, or at close intervals;

completely interrupting, after the flashover, the current supply to the electrodes of said precipitator during a first time interval;

supplying a current which is greater than the one supplied immediately before the flashover to said precipitator during a second time interval which directly follows the first time interval; and subsequently reducing the current to a value below the one prevailing immediately before the flashover.

2. Method as claimed in claim 1, wherein the charge which the precipitator loses in a flashover is measured or calculated, and the length of the second time interval is calculated such that the main portion of the charge lost in the flashover is reset during said second time interval.

3. Method as claimed in claim 2, wherein a current essentially exceeding the one supplied immediately before the flashover is supplied to said precipitator during the second time interval, and the length of the second time interval is adapted such that the entire theoretically lost charge is supplied to the precipitator during said second time interval.

4. Method as claimed in claim 2, wherein a current which is essentially equal to the maximum current of a rectifier is supplied to said precipitator during the second time interval.

5. Method as claimed in claim 2, wherein the capacitance of said precipitator is measured or calculated, and the lost charge is calculated as the product of said capacitance and the voltage between the electrodes of said precipitator immediately before the flashover.

6. Method as claimed in claim 2, wherein the current is integrated during the second time interval, and this second interval is terminated when the integrated current essentially conforms with the measured or calculated, lost charge.

7. Method as claimed in claim 1, wherein the first time interval is less than 5 milliseconds.

8. Method as claimed in claim 1, wherein the second time interval is less than 20 milliseconds.

9. Method as claimed in claim 3, wherein a current which is essentially equal to the maximum current of a rectifier is supplied to said precipitator during the second time interval.

10. Method as claimed in claim 3, wherein the capacitance of said precipitator is measured or calculated, and the lost charge is calculated as the product of said capacitance and the voltage between the electrodes of said precipitator immediately before the flashover.

11. Method as claimed in claim 4, wherein the capacitance of said precipitator is measured or calculated, and the lost charge is calculated as the product of said capacitance and the voltage between the electrodes of said precipitator immediately before the flashover.

12. Method as claimed in claim 9, wherein the capacitance of said precipitator is measured or calculated, and the lost charge is calculated as the product of said capacitance and the voltage between the electrodes of said precipitator immediately before the flashover.

13. Method as claimed in claim 3, wherein the current is integrated during the second time interval, and the second interval is terminated when the integrated current essentially conforms with the measured or calculated lost charge.

14. Method as claimed in claim 4, wherein the current is integrated during the second time interval, and the second interval is terminated when the integrated current essentially conforms with the measured or calculated lost charge.

15. Method as claimed in claim 5, wherein the current is integrated during the second time interval, and this second interval is terminated when the integrated current essentially conforms with the measured or calculated lost charge.

16. Method as claimed in claim 9, wherein the current is integrated during the second time interval, and this second interval is terminated when the integrated current essentially conforms with the measured or calculated lost charge.

17. Method as claimed in claim 10, wherein the current is integrated during the second time interval, and this second interval is terminated when the integrated current essentially conforms with the measured or calculated lost charge.

18. Method as claimed in claim 11, wherein the current is integrated during the second time interval, and this second interval is terminated when the integrated current essentially conforms with the measured or calculated lost charge.

19. Method as claimed in claim 12, wherein the current is integrated during the second time interval, and this second interval is terminated when the integrated current essentially conforms with the measured or calculated lost charge.

20. Method as claimed in claim 2, wherein the second time interval is less than 20 milliseconds.

21. Method as claimed in claim 1, wherein the second time interval is less than 10 milliseconds.

22. Method as claimed in claim 2, wherein the second time interval is less than 10 milliseconds.

23. Method as claimed in claim 1, wherein the first time interval is less than 1 millisecond.

* * * * *